US009630730B2

(12) United States Patent
Leppert

(10) Patent No.: US 9,630,730 B2
(45) Date of Patent: Apr. 25, 2017

(54) PNEUMATIC STRAPPING APPARATUS

(71) Applicant: FROMM HOLDING AG, Cham (CH)

(72) Inventor: Klaus Leppert, Seebach (DE)

(73) Assignee: FROMM HOLDING AG, Cham (CH)

( * ) Notice: Subject to any disclaimer, the term of this patent is extended or adjusted under 35 U.S.C. 154(b) by 453 days.

(21) Appl. No.: 14/303,239

(22) Filed: Jun. 12, 2014

(65) Prior Publication Data

US 2014/0290192 A1 Oct. 2, 2014

Related U.S. Application Data

(63) Continuation of application No. PCT/EP2012/005293, filed on Dec. 20, 2012.

(30) Foreign Application Priority Data

Dec. 23, 2011 (DE) ..... 10 2011 122 155

(51) Int. Cl.
*B65B 13/18* (2006.01)
*B65B 13/32* (2006.01)
*B65B 13/02* (2006.01)

(52) U.S. Cl.
CPC ..... *B65B 13/188* (2013.01); *B65B 13/025* (2013.01); *B65B 13/322* (2013.01)

(58) Field of Classification Search
CPC ... B65B 13/188; B65B 13/025; B65B 13/322; B65B 13/02; B65B 13/32; B65B 13/327
See application file for complete search history.

(56) References Cited

U.S. PATENT DOCUMENTS 3,319,666 A * 5/1967 Langford ..... B65B 13/188 140/152
3,544,029 A * 12/1970 Meier ..... B65B 13/18 242/420.6

(Continued)

FOREIGN PATENT DOCUMENTS

EP 0 560 082 A1 9/1993
GB 1 054 034 A 1/1967

(Continued)

OTHER PUBLICATIONS

The PCT International Search Report mailed May 15, 2013 by ISA/EP and issued in a related PCT International Patent Application No. PCT/EP2012/005293, filed Dec. 20, 2012 (3 pages).

*Primary Examiner* — Christopher Harmon
(74) *Attorney, Agent, or Firm* — Robert P. Michael, Esq.; Carter, DeLuca, Farrell & Schmidt, LLP.

(57) ABSTRACT

A pneumatically actuated strapping apparatus for strapping plastic tape around a packaging item including a motorized tensioning device and a motorized welding device for the plastic tape. The tensioning device and the welding device are driven by the same pneumatic motor. The direction of rotation of the pneumatic motor can be inverted. The pneumatic motor is connected to the devices by two freewheeling mechanisms releasing the devices in opposite directions. In order to keep power consumption for evacuating non-operational air low, in a particularly preferred embodiment, switching valves which automatically discharge the nonoperational air to the exterior are integrated into the air intake ducts that are used as evacuation ducts for the non-operational air when the direction of rotation is inverted.

4 Claims, 2 Drawing Sheets

(56) References Cited

U.S. PATENT DOCUMENTS

| | | | | | |
|---|---|---|---|---|---|
| 3,648,739 | A * | 3/1972 | Angarola | B65B 13/327 | 100/33 PB |
| 3,654,033 | A * | 4/1972 | Angarola | B65B 13/188 | 100/30 |
| 4,313,779 | A * | 2/1982 | Nix | B65B 13/322 | 100/33 PB |
| 5,954,899 | A * | 9/1999 | Figiel | B65B 13/327 | 100/33 PB |
| 6,192,781 | B1 * | 2/2001 | Thames | F15B 13/0406 | 91/30 |
| 6,966,255 | B1 * | 11/2005 | Crittenden | B65B 13/025 | 100/29 |
| 8,967,217 | B2 * | 3/2015 | Gardner | B65B 13/025 | 100/33 PB |
| 9,315,283 | B2 * | 4/2016 | Neeser | B65B 13/327 | |

FOREIGN PATENT DOCUMENTS

| | | |
|---|---|---|
| WO | WO 2006/132572 A1 | 12/2006 |
| WO | WO 2009/129634 A1 | 10/2009 |

* cited by examiner

PNEUMATIC STRAPPING APPARATUS

CROSS-REFERENT TO RELATED APPLICATIONS

This is a Continuation application under 37 CFR 1.53(b) of PCT International Patent Application No. PCT/EP2012/005293, filed Dec. 20, 2012 entitled PNEUMATIC STRAPPING APPARATUS, which claims the benefit of German Application Serial No. 10 2011 122 155.0 filed Dec. 23, 2011, the entire contents of each of which are herein incorporated by reference.

BACKGROUND INFORMATION

The invention relates to a pneumatically actuated strapping apparatus for strapping a plastics tape around a package, including a motorized tensioning device and a motorized welding device for the plastics tape.

Apparatus of this type are known. The plastics tape is firstly placed in a loop around a package, wherein a first, free end forms at a welding point a bottom band. The other end of the plastics tape loop is guided as a top band, together with the bottom band, at a connecting point through the welding device, and subsequently runs to the tensioning device. In the tensioning device is then provided a friction wheel or a similar element, which is driven by a motor. This motorized friction wheel grips the top band and thereby tautens the loop around the package.

Once the plastics tape is then wound tightly around the package, it is compressed in this state at the place where it runs through the welding device. There, a vibrating plate, as part of the welding device, is then lowered onto the clamped-together bands and set in vibration. The vibration is generated by a motor via a gear mechanism. Due to this vibration, a relative movement ensues between the top and the bottom band, which, owing to the friction which is hereupon generated, leads to local fusion of the thermoweldable plastics tape. Following completion of the vibration movement and a short period of cooling, the top band and the bottom band are then welded together at the connecting point.

During the vibration or during the welding operation, respectively, the top band is usually cut off next to the connecting point. Finally, the strapping apparatus can then be removed from the package around which the plastics tape is wound.

Since strapping apparatus are used at a wide variety of locations and, due to different packages, also in a wide variety of positions, they are often handled manually and moved, for example, to their various usage sites. From this point of view, it is important that the apparatus creates minimal physical loads for a user.

SUMMARY

An object of the present invention is therefore to make a strapping apparatus of this type as light as possible.

This object is achieved according to the invention by virtue of the fact that the tensioning device and the welding device which are provided on the strapping apparatus are driven by one and the same pneumatic motor.

The invention has the advantage that only one motor is used, even though a plurality of sub-assemblies which are to be motor-driven are present in the strapping apparatus. It is thus possible to economize on motor drives, which implies a weight benefit. Moreover, as a result of the savings on expensive pneumatic motors, cost benefits can also be obtained.

In a particularly preferred embodiment of the invention, the pneumatic motor is reversible in terms of its direction of drive and is here operatively connected alternatively to the tensioning or the welding device via freewheels (or roller clutches), which latter allow free movement in opposite directions.

A design in this manner has the advantage that it is very operationally reliable. It serves to ensure that either the tensioning or else the welding device are driven, but not both devices at the same time. This alternative drive can here be realized without a complex control system, which latter would have both weight and cost disadvantages.

In terms of design, it is proposed that the pneumatic motor has a motor shaft which protrudes at both ends of the motor and which, at its ends protruding from the motor, is respectively connected to one of the freewheels (or roller clutches), which latter allow free movement in opposite directions.

The effect of these designs is that the motor shaft has to transfer torsional moments only over short distances. It can thus be dimensioned smaller and is also therefore lighter.

Although it would also be possible to mount the freewheels (or roller clutches), which allow free movement in opposite directions of rotation, on the same side of the pneumatic motor on the motor shaft thereof, given a reduction in motor power via the freewheel (or roller clutch) which is more distant from the pneumatic motor, the torques would then have to be conducted over a longer distance through the motor shaft. Since each shaft is provided with a certain torsional elasticity, undesirable effects could hereby also possibly arise in the switchover from one to the other direction of rotation.

Moreover, the shaft would then have to be dimensioned larger, which would act counter to the aim of an apparatus which is as light as possible.

As has been described above, the alternative connection of the pneumatic motor to the tensioning device or to the welding device is realized by a reversal of its running direction.

In order to allow the pneumatic motor to run in opposite directions, it has, in particular, two inlet air ducts, which are alternatively to be subjected to compressed air.

This compressed air, following its expansion in the rotor of the pneumatic motor, which expansion leads to the rotation of said rotor, is evacuated in a known manner through the central outlet into the environment.

It is here customary to also direct the idle air of the compressed air motor via this central outlet. By idle air is here understood within the scope of the present application that air which, upon rotation of the reversible pneumatic motor, is compressed in the cells of the rotor, which cells, during the rotation in the opposite direction, are utilized for the expansion of the compressed air. This idle air is fed to the central outlet here normally via appropriate ducts and valves which clear these ducts.

Since these ducts and valves for the idle air constitute resistances, however, a part of the power delivered by the pneumatic motor has to be used for the expulsion of the idle air. The motor must thus be constructed correspondingly larger for the provision of this power and is thus, in turn, relatively heavier.

In order to avoid this drawback, for a particularly preferred embodiment of the invention it is hence proposed that into the inlet air ducts for the reversible pneumatic motor, which are to be alternatively subjected to compressed air, are integrated reversing valves, which respectively automatically vent outward in the event of an opposite flow.

These valves should here be provided in an integrated manner quite close to the rotor of the pneumatic motor, in particular as the, in the flow direction of the inflowing compressed air, last structural element before the rotor. When the pneumatic motor is switched over into the other direction of rotation, the duct which has just been used for the inlet air acts as the waste air duct. The idle air of the motor then flows through this waste air duct and reaches, first of all, the reversing valve. Up to this reversing valve, only a short duct length has therefore to be surmounted by the idle air, which considerably reduces friction loss and thus the power required to expel the idle air.

A corresponding pneumatic motor can hence be constructed with less power and thus also in smaller dimensions, and the weight of a corresponding pneumatic strapping apparatus is accordingly reduced further.

In a particularly preferred embodiment, a cross-sectionally substantially M-shaped switching diaphragm, which, according to its approach flow direction, is switchable between a release position for the inlet air duct and a release position for the outlet opening of the reversing valve to the environment, is present in the reversing valves.

BRIEF DESCRIPTION OF THE DRAWINGS

Further advantages and features of the invention emerge from the following description of an illustrative embodiment, wherein.

DETAILED DESCRIPTION

Figure 1:
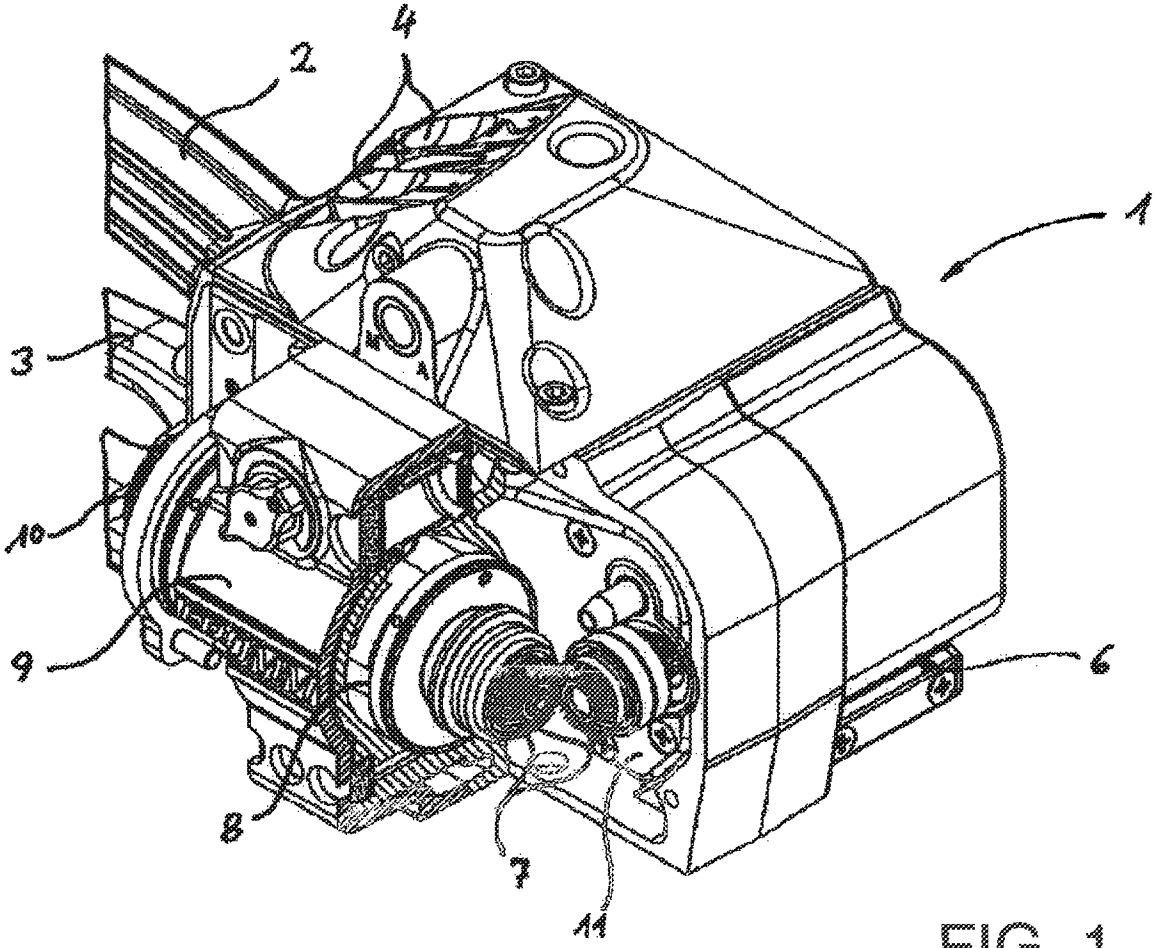
FIG. 1 shows the working head of a pneumatically operated strapping apparatus in perspective view.

In FIG. 1, the perspective view of the working head of a pneumatically actuated strapping apparatus can be seen. Mounted on this working head is a handle 2, by means of which the strapping apparatus is handled. Beneath this handle is here found an actuating lever 3, by means of which, together with the actuation of push buttons 4, the pneumatic strapping apparatus is controlled.

In the use of the strapping apparatus, a plastics tape is guided through a slot 6 situated on the away-facing side in FIG. 1. The plastics tape is then placed around a package to be strapped and is then guided once again through the slot 6. The plastics tape is thus placed in a loop around the package.

The plastics tape is then tautened via a motorized friction wheel, so that it lies tightly around the package. Finally, the plastics tape, at a position within the strapping apparatus on which it overlaps after formation of the loop, is then compressed to form a connecting point At this position, a vibrating plate is then lowered onto the clamped-together bands and this vibrating plate is set in vibration by motorized means. Due to this vibration, there ensues a relative movement at the connecting point between the two overlapping tape portions and, owing to the friction which is hereupon generated, a local fusion of the thermoweldable plastics tape.

Finally, this welded connecting point can then cool down, so that a solid welding point is formed and the strapping apparatus can be removed from the packing tape, whereupon the packing tape slides out of the slot 6.

The above-discussed friction wheel is driven via a bevel gearing 7 by a pneumatic motor 8. In FIG. 1 is represented a housing 9, which normally fully covers the bevel gearing 7 and the pneumatic motor 8, but here, for better clarity, is broken open and partially omitted.

At its end lying axially opposite the bevel gearing 7, the pneumatic motor 8 bears a further gearwheel 10, via which it can be connected in a known manner to the vibration drive for the welding or vibrating plate.

The motor is mounted, for easier assembly, on a base plate 11. The easy exchangeability thereof also facilitates the assembly and subsequent maintenance of the strapping apparatus.

Figure 2:
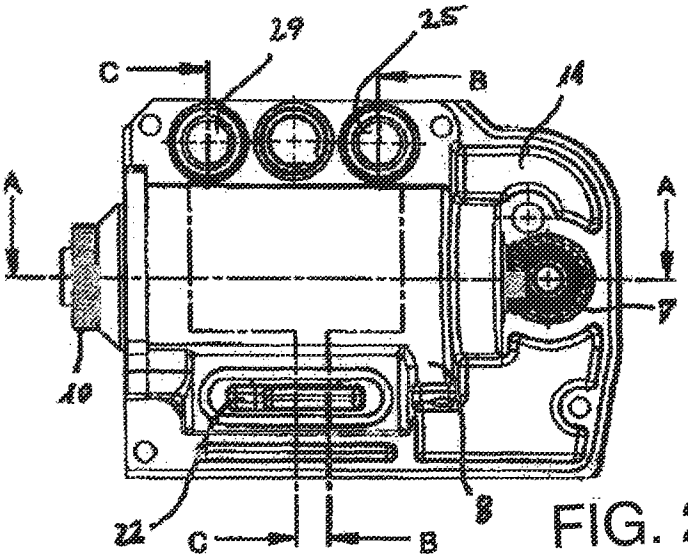
FIG. 2 shows the side view of a pneumatic drive motor for a working head according to FIG. 1.

In FIG. 2, the base plate 11, with pneumatic motor mounted thereon and the bevel gearing 7 likewise mounted thereon, is represented in side view. In FIG. 2 can also be seen the gearwheel 10, which is likewise seated on the pneumatic motor 8.

Figure 3:
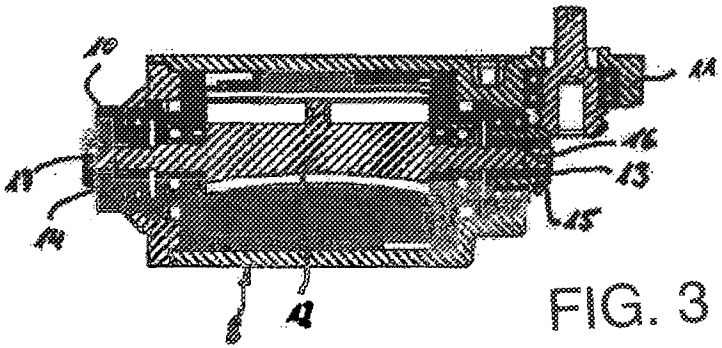
FIG. 3 shows a sectional view along the line A-A in FIG. 2.

In FIG. 3, which represents a section transversely through the pneumatic motor 8 along the line A-A in FIG. 2, it can be seen that the motor shaft 12 of the pneumatic motor 8 terminates on the two sides of the pneumatic motor in shaft ends 13, 14. On these shaft ends 13, 14 is seated, on the one hand, a bevel wheel 15, which is part of the bevel gearing 7. At the opposite end, the motor shaft 12 bears the above-discussed gearwheel 10.

Both the gearwheel 10 and the bevel wheel 15 do not in this case sit directly on the shaft ends 13, 14, but rather freewheels as drawn cup roller clutches 16, 17 are interposed here.

These two drawn cup roller clutches 16, 17 release the torque transmission in respectively opposite directions of rotation, so that, upon rotation of the pneumatic motor 18 or its motor shaft 12, either the bevel wheel 15, or the gearwheel 10, are co-rotated. The respectively other wheel is disconnected via the interposed drawn cup roller clutches and, accordingly, is not driven. There is thus the possibility of actuating with just one motor 8 either the friction wheel drive or alternatively (but not simultaneously) the vibration drive. Two different places at which power is required can thus be served with just one motor.

Figure 5:
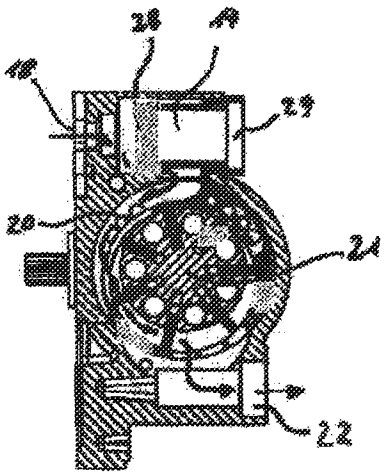
FIG. 5 shows a sectional view along the line C-C in FIG. 2.

For the actuation of the pneumatic motor, compressed air is fed to it, as represented in FIG. 5, via an inlet air port 18. This compressed air flows past a reversing valve 19 (described in greater detail below) through an inlet air duct 20 to the rotor 21 of the pneumatic motor 8. This compressed air sets the rotor 21 in rotation and then flows off from the pneumatic motor 8 via a central outlet 22.

Figure 4:
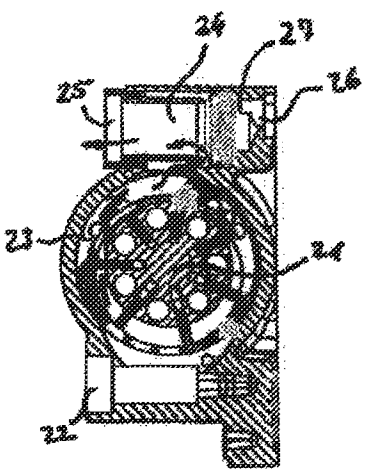
FIG. 4 shows a sectional view along the line B-B in FIG. 2.

The idle air generated by the rotor 21 in the course of its rotation takes the course represented in FIG. 4. It flows through a duct 23 to a further reversing valve 24 and, at this, is evacuated to the environment directly through an outlet opening 25 provided thereon.

The idle air of the pneumatic motor 8 does not therefore have to be guided through possibly narrow ducts firstly to the central outlet 22.

If the pneumatic motor 8 is now driven in the opposite direction, compressed air is fed to it via another inlet air port 26, which is represented in FIG. 4. The reversing valve 24 closes with its diaphragm 27 the outlet opening 25 and the compressed air then flows through the duct 23, as the inlet air duct, to the rotor 21. The latter is rotated in the opposite direction and the compressed air which drives it then flows off into the environment through the central outlet 22.

At the same time, the idle air which is here generated by the rotor 21 flows through the duct 20 (discernible in FIG. 5) to the reversing valve 12. There, the cross-sectionally substantially M-shaped diaphragm 28 thereof is pressed in front of the inlet air port 18, so that the idle air flows through the reversing valve 19 to an outlet opening 29 provided thereon, where it is discharged to the environment, again without having previously been conducted through possibly narrow ducts firstly to the central outlet 22.

The cross-sectionally substantially M-shaped diaphragms 27, 28 can respectively alternatively close off the inlet air ports 18 and 26, or else the duct portions which in the valves 19 and 24 lead to the outlet openings 29 and 25. At the same time, the diaphragms, with their radially outer sealing lips, make it possible, as represented in FIG. 5, for inlet air in the radially outer region of the reversing valve 19 or 24 to be able to flow past them to the inlet air duct 20 or 23, or else, as represented in FIG. 4, for the idle air which meets the inlet air and flows off from the pneumatic motor to be able to displace the diaphragms for sealing off of the inlet air ports and for simultaneous release of the duct portions to the outlet openings.

What is claimed is:

1. A pneumatically actuated strapping apparatus for strapping a plastics tape around a package, comprising:

a motorized tensioning device;

a motorized welding device for the plastics tape, wherein the motorized tensioning device and the motorized welding device are operatively coupled to and driven by a same pneumatic motor, wherein the pneumatic motor is reversible and comprises two inlet air ducts which are alternatively subjected to compressed air flowing in a first direction, each inlet air duct having respective integrated reversing valves disposed therein which automatically vent directly outward in the event of an air flow that is in an opposite direction of the first flow direction.

2. The strapping apparatus as claimed in claim 1, wherein the pneumatic motor can be operatively connected alternatively to the motorized tensioning device or the motorized welding device via freewheels, the freewheels permitting free movement in opposite directions.

3. The strapping apparatus as claimed in claim 1, wherein the pneumatic motor comprises a motor shaft protruding from both ends of the pneumatic motor, wherein each shaft end is connected to one of the freewheels, respectively, the freewheels permitting free movement in opposite directions.

4. The strapping apparatus as claimed in claim 1, wherein each reversing valves includes a respective cross-sectionally substantially M-shaped switching diaphragm.

* * * * *